US011786768B2

(12) United States Patent
Bouchard

(10) Patent No.: US 11,786,768 B2
(45) Date of Patent: Oct. 17, 2023

(54) KITCHEN FIRE SUPPRESSION AIMING SYSTEMS AND METHODS

(71) Applicant: Carrier Corporation, Palm Beach Gardens, FL (US)

(72) Inventor: Karen K. Bouchard, Palm Beach Gardens, FL (US)

(73) Assignee: Carrier Corporation, Palm Beach Gardens, FL (US)

( * ) Notice: Subject to any disclaimer, the term of this patent is extended or adjusted under 35 U.S.C. 154(b) by 0 days.

(21) Appl. No.: 17/253,533

(22) PCT Filed: Dec. 9, 2019

(86) PCT No.: PCT/US2019/065181
§ 371 (c)(1),
(2) Date: Dec. 17, 2020

(87) PCT Pub. No.: WO2020/123356
PCT Pub. Date: Jun. 18, 2020

(65) Prior Publication Data

US 2021/0252319 A1 Aug. 19, 2021

Related U.S. Application Data

(60) Provisional application No. 62/778,413, filed on Dec. 12, 2018.

(51) Int. Cl.

| | |
|---|---|
| ***A62C 3/00*** | (2006.01) |
| ***A62C 37/40*** | (2006.01) |
| ***A62C 31/03*** | (2006.01) |

(52) U.S. Cl.
CPC ..... *A62C 3/006* (2013.01); *A62C 31/03* (2013.01); *A62C 37/40* (2013.01)

(58) Field of Classification Search
CPC ..... A62C 3/006; A62C 31/03; A62C 37/40
See application file for complete search history.

(56) References Cited

U.S. PATENT DOCUMENTS 3,490,206 A * 1/1970 Doane ..... F24C 15/20 55/467
3,820,714 A * 6/1974 Erickson et al. ..... B05B 3/08 239/10
3,889,754 A * 6/1975 Dunn ..... A62C 3/006 169/59

(Continued)

FOREIGN PATENT DOCUMENTS

CN 204073216 U 1/2015
CN 205073578 U 3/2016

(Continued)

OTHER PUBLICATIONS

International Search Report and Written Opinion for International Patent Application No. PCT/US2019/065181 dated Feb. 11, 2020.

*Primary Examiner* — Joseph A Greenlund
(74) *Attorney, Agent, or Firm* — Carlson, Gaskey & Old, P.C.

(57) ABSTRACT

A method of suppressing a kitchen fire includes detecting a fire and identifying a location of the fire with a tracking system, aiming a nozzle at the location, and releasing an agent through the nozzle at the location.

19 Claims, 5 Drawing Sheets

(56) References Cited

U.S. PATENT DOCUMENTS 3,897,828 A * 8/1975 Glover ..... A62C 37/12 169/65
4,121,767 A * 10/1978 Jensen ..... G05D 21/02 239/71
4,256,181 A * 3/1981 Searcy ..... A62C 37/12 169/65
4,821,805 A * 4/1989 Saito ..... A62C 37/00 169/61
4,979,572 A * 12/1990 Mikulec ..... A62C 3/006 239/524
5,127,479 A * 7/1992 Stehling ..... A62C 3/006 285/31
5,351,760 A * 10/1994 Tabor, Jr. ..... A62C 3/006 169/59
5,727,634 A * 3/1998 Ishida ..... A62C 31/05 169/61
5,899,278 A * 5/1999 Mikulec ..... A62C 3/006 169/65
6,029,751 A * 2/2000 Ford ..... A62C 3/006 169/65
6,341,655 B1 * 1/2002 Busian ..... A62C 2/04 169/59
6,523,210 B1 * 2/2003 Andros ..... B08B 3/04 15/1.51
6,834,728 B2 * 12/2004 Demole ..... A62C 3/0292 269/302
RE39,081 E * 5/2006 Thomas ..... A62C 37/38 250/342
7,389,824 B2 * 6/2008 Jackson ..... A62C 35/58 239/69
7,681,655 B2 * 3/2010 Biehl ..... A47J 37/1266 169/65
9,345,914 B1 * 5/2016 Ali ..... A62C 35/15
9,964,495 B1 * 5/2018 Marshall ..... B05B 12/082
10,850,146 B2 * 12/2020 Lee ..... B05B 3/1035
11,191,986 B2 * 12/2021 Hart ..... A62C 31/03
2001/0032546 A1 * 10/2001 Sharpe ..... A47J 45/068 99/422
2003/0094287 A1 * 5/2003 Demole ..... A62C 3/0221 169/30
2004/0016348 A1 * 1/2004 Sharpe ..... A47J 36/321 99/422
2004/0129434 A1 * 7/2004 Tan ..... A62C 37/40 239/69
2004/0199302 A1 * 10/2004 Pillar ..... B65F 3/045 701/1
2005/0126797 A1 * 6/2005 Mikulec ..... A62C 37/38 169/65
2005/0242086 A1 * 11/2005 Imura ..... A47J 36/321 219/627
2006/0272832 A1 * 12/2006 Biehl ..... A62C 31/02 169/65
2007/0169948 A1 * 7/2007 Vidojevic ..... A62C 3/006 169/56
2007/0246234 A1 * 10/2007 Vegso ..... A62C 37/12 169/59
2008/0314602 A1 * 12/2008 Lohnes ..... A62C 13/78 169/56
2011/0000686 A1 * 1/2011 Munro ..... A62C 3/006 169/54
2011/0268153 A1 * 11/2011 He ..... A47J 45/068 374/E7.004
2012/0018179 A1 * 1/2012 Munro ..... A62C 37/40 169/65
2013/0092404 A1 * 4/2013 Mikulec ..... A62C 3/006 169/65
2013/0161343 A1 * 6/2013 Ferron ..... A47J 45/068 220/756
2013/0186655 A1 * 7/2013 Mauney ..... A62C 3/006 169/74
2014/0076588 A1 * 3/2014 Procious ..... A62C 35/13 169/52
2015/0021054 A1 * 1/2015 McNamara ..... A62C 35/023 169/61
2016/0030782 A1 * 2/2016 Livchak ..... A62C 3/006 169/46
2016/0030784 A1 * 2/2016 Tsutaki ..... A62C 3/0292 169/61
2016/0120118 A1 * 5/2016 Bouten ..... A01M 7/0092 222/145.6
2016/0236021 A1 * 8/2016 Ehlers ..... A62C 35/02
2016/0271434 A1 * 9/2016 Dusing ..... H04L 67/12
2016/0321900 A1 * 11/2016 Rao ..... B05B 12/12
2016/0354626 A1 * 12/2016 McNamara ..... A62C 35/023
2017/0144002 A1 * 5/2017 Ben Neria ..... A62C 37/44
2017/0259097 A1 * 9/2017 Orglmeister ..... A62C 37/10
2017/0319882 A1 * 11/2017 Hart ..... A62C 31/03
2018/0169450 A1 * 6/2018 Moffa ..... G08B 29/145
2019/0099631 A1 * 4/2019 Hart ..... A62C 37/36
2019/0129428 A1 * 5/2019 Chao ..... A62C 31/24
2019/0321668 A1 * 10/2019 Lee ..... A62C 37/40
2020/0077838 A1 * 3/2020 Paller ..... G01K 13/00
2020/0121967 A1 * 4/2020 Gladstone ..... H04N 7/188
2020/0384294 A1 * 12/2020 Zhou ..... A62C 13/78
2021/0134131 A1 * 5/2021 Shin ..... A62C 99/009
2021/0252319 A1 * 8/2021 Bouchard ..... A62C 31/03

FOREIGN PATENT DOCUMENTS

CN 205127205 U 4/2016
CN 106110537 A 11/2016
CN 104080699 B 12/2016
CN 206059136 U 3/2017
CN 106975181 A 7/2017
CN 107019860 A 8/2017
CN 206852953 U 1/2018
CN 108014440 A 5/2018
EP 0878212 A2 11/1998
KR 2020120001187 U 2/2012
KR 20130015056 A 2/2013
KR 101244426 B1 3/2013
KR 101717579 B1 3/2017
KR 1020170099119 A 8/2017
KR 101827746 B1 2/2018
KR 101840175 B1 3/2018
WO 2006127120 A1 11/2006
WO 2016024267 A1 2/2016
WO 2018175495 A1 9/2018

* cited by examiner

KITCHEN FIRE SUPPRESSION AIMING SYSTEMS AND METHODS

CROSS-REFERENCE TO RELATED APPLICATIONS

This application claims priority to U.S. Provisional Application No. 62/778,413, which was filed on Dec. 12, 2018 and is incorporated herein by reference.

BACKGROUND

This system relates generally to fire suppression systems and methods, and more particularly to fire suppression systems and methods for kitchen appliances.

Kitchens may include range top appliances with cookware and/or other kitchen appliances for cooking food. Kitchen appliances may create fire hazards, and kitchen fire suppression systems are utilized to suppress these fires.

SUMMARY

A method of suppressing a kitchen fire according to an example of the present disclosure includes detecting a fire and identifying a location of the fire with a tracking system. The method includes aiming a nozzle at the location. The method includes releasing an agent through the nozzle at the location.

In a further example according to any of the foregoing examples, aiming includes moving the nozzle laterally.

In a further example according to any of the foregoing examples, the lateral movement includes moving the nozzle along a track within a hood of a range top.

In a further example according to any of the foregoing examples, the agent is stored in a cylinder, and the nozzle is in fluid communication with the cylinder through a hose.

In a further example according to any of the foregoing examples, the aiming includes rotatabaly moving the nozzle.

In a further example according to any of the foregoing examples, the aiming includes angular movement of the nozzle.

In a further example according to any of the foregoing examples, aiming includes detecting an object between a target area and the nozzle and moving the nozzle such that the object is not between the target area and the nozzle.

In a further example according to any of the foregoing examples, the tracking system includes at least one optical sensor.

In a further example according to any of the foregoing examples, temperature information is received from a chip in a piece of cookware. The detecting includes determining that the fire exists based on the temperature information.

In a further example according to any of the foregoing examples, the location of the chip is identified with a positioning system.

In a further example according to any of the foregoing examples, the positioning system is a radio frequency identification system.

A fire suppression system for a kitchen according to an example of the present disclosure includes a tracking system that is configured to sense a location of a fire in the kitchen. A nozzle is movable to a select position based on the sensing and is configured to release fire suppression agent onto the fire.

In a further example according to any of the foregoing examples, the nozzle is movable laterally to the select position.

In a further example according to any of the foregoing examples, the lateral movement includes movement along a track within a hood of a range top.

In a further example according to any of the foregoing examples, the nozzle is movable rotatably to the select position.

In a further example according to any of the foregoing examples, the rotatable movement includes rotation of a swivel joint.

In a further example according to any of the foregoing examples, the nozzle is movable angularly to the select position.

In a further example according to any of the foregoing examples, a controller is configured to send control signals to move the nozzle based on the sensing.

In a further example according to any of the foregoing examples, the tracking system includes an infrared sensor for sensing the location of the fire.

In a further example according to any of the foregoing examples, the nozzle is in fluid communication with an agent cylinder through a flexible hose.

These and other features may be best understood from the following specification and drawings, the following of which is a brief description.

BRIEF DESCRIPTION OF THE DRAWINGS

FIG. 8 is a flowchart of an example method of tracking a cookware on a range top or other appliance for fire suppression.

DETAILED DESCRIPTION

Figure 1:
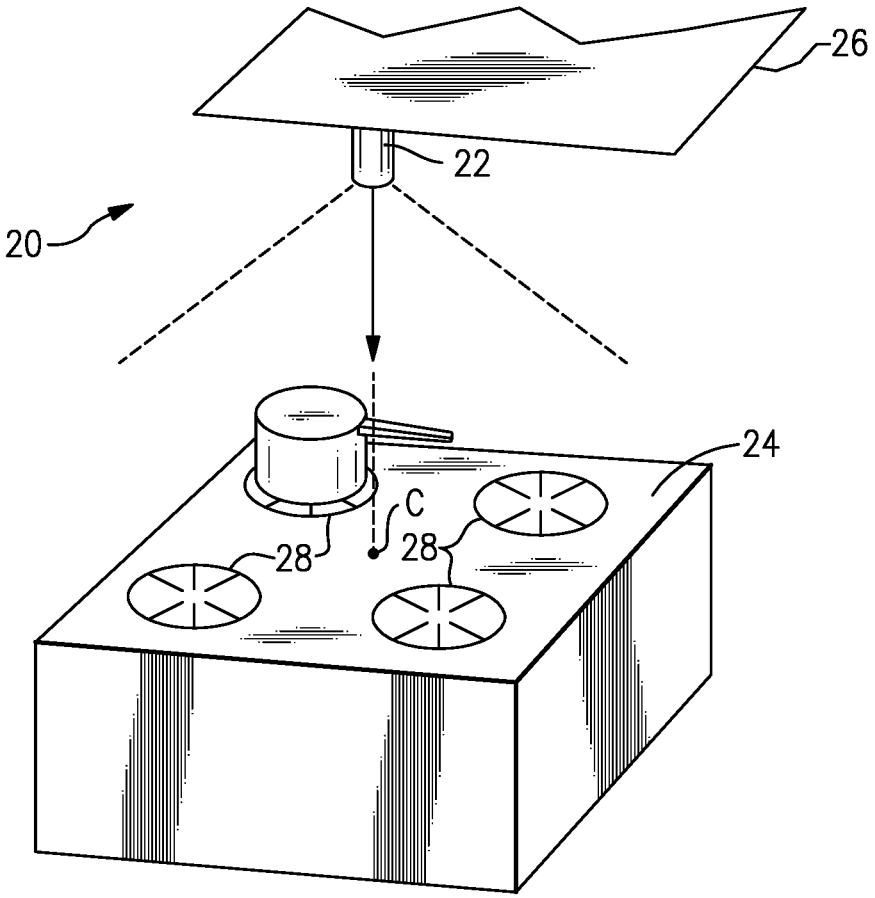
FIG.1 Prior Art
FIG. 1 illustrates a prior art fire suppression system.

FIG. 1 illustrates a prior art fire suppression system 20. A nozzle 22 is configured to release fire extinguishing agent onto an appliance such as range top 24 and maybe located vertically above the range top 24. The nozzle 22 may be adjacent or in a hood 26 used for ventilation of the range top 24 area. The nozzle 22 aim point C is centrally located relative to the range top 24 with a swivel joint (not shown) and has a wide coverage or spray angle to reach the entire range top 24 in the case of a fire, as shown schematically. The nozzle 22 may be manually aimed at the central aim point C upon installation. The range top 24 may include multiple burners 28, each being within the spray coverage of the nozzle 22. The system 20 releases agent onto the entire coverage area to suppress a fire, even if the fire is only located at one of the burners 28, for example. The nozzle 22 may be dedicated to a single range top 24 or other appliance.

Figure 2:
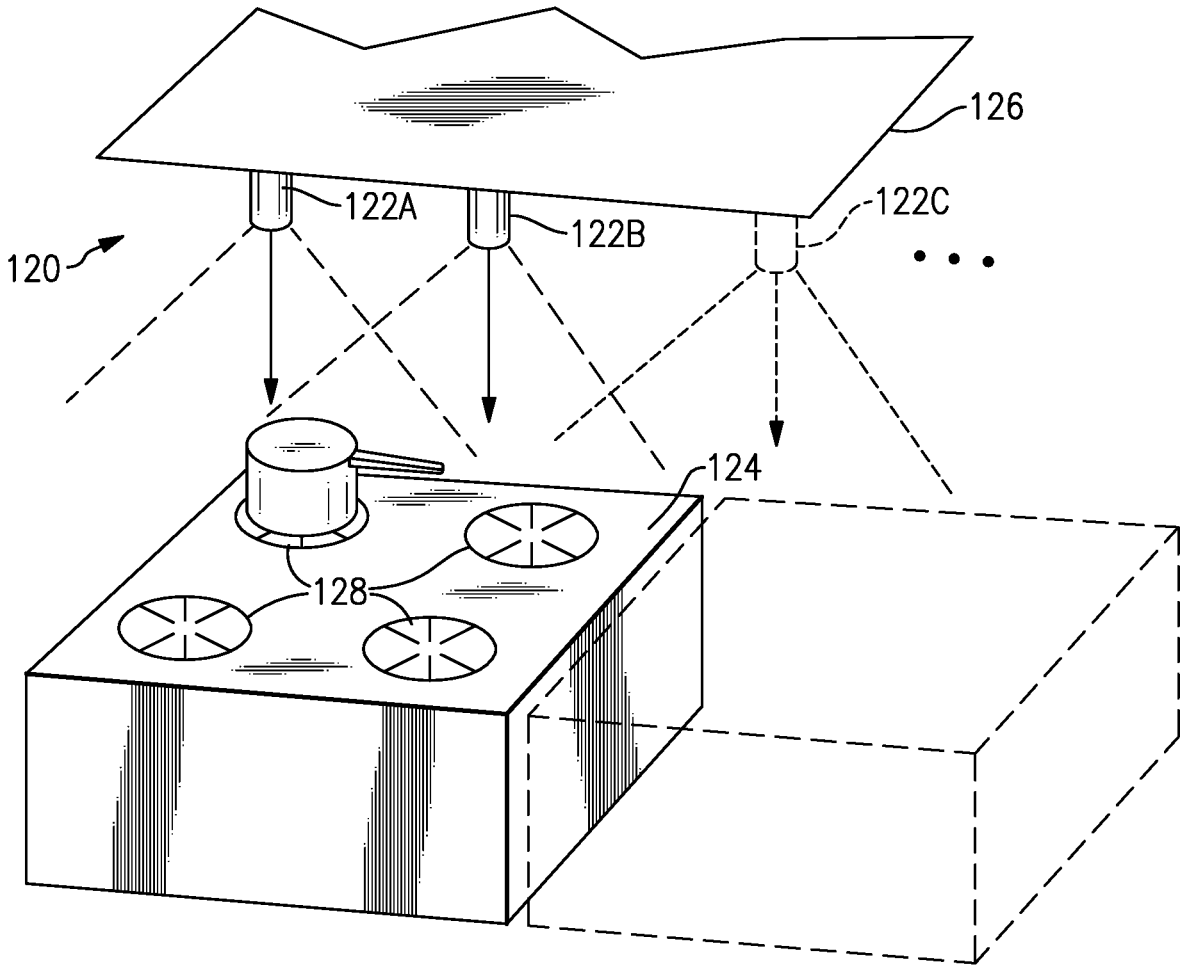
FIG.2 Prior Art
FIG. 2 illustrates a second prior art fire suppression system.

FIG. 2 illustrates a prior art fire suppression system 120 including multiple equally spaced apart nozzles 122A, 122B vertically above a range top 124 and adjacent a hood 126. Like reference numerals identify corresponding or similar elements throughout the several drawings. The combined coverage area of the nozzles 122A, 122B covers the entire range top 124 and any other appliances placed underneath the overlapping coverage "zone," as shown schematically. The spray coverage area of the nozzle 122A overlaps with the spray coverage area of the nozzle 122B to create the zone coverage area. The system 120 releases agent onto the entire zone coverage area to suppress a fire, even if the fire is only located at one of the burners 128, for example. One or more additional nozzles 122C may be utilized, as shown schematically. The system 120 may not have dedicated nozzles 122 to specific range tops 124, and range tops 124 and other appliances may instead be moved about within the zone coverage.

Figure 3:
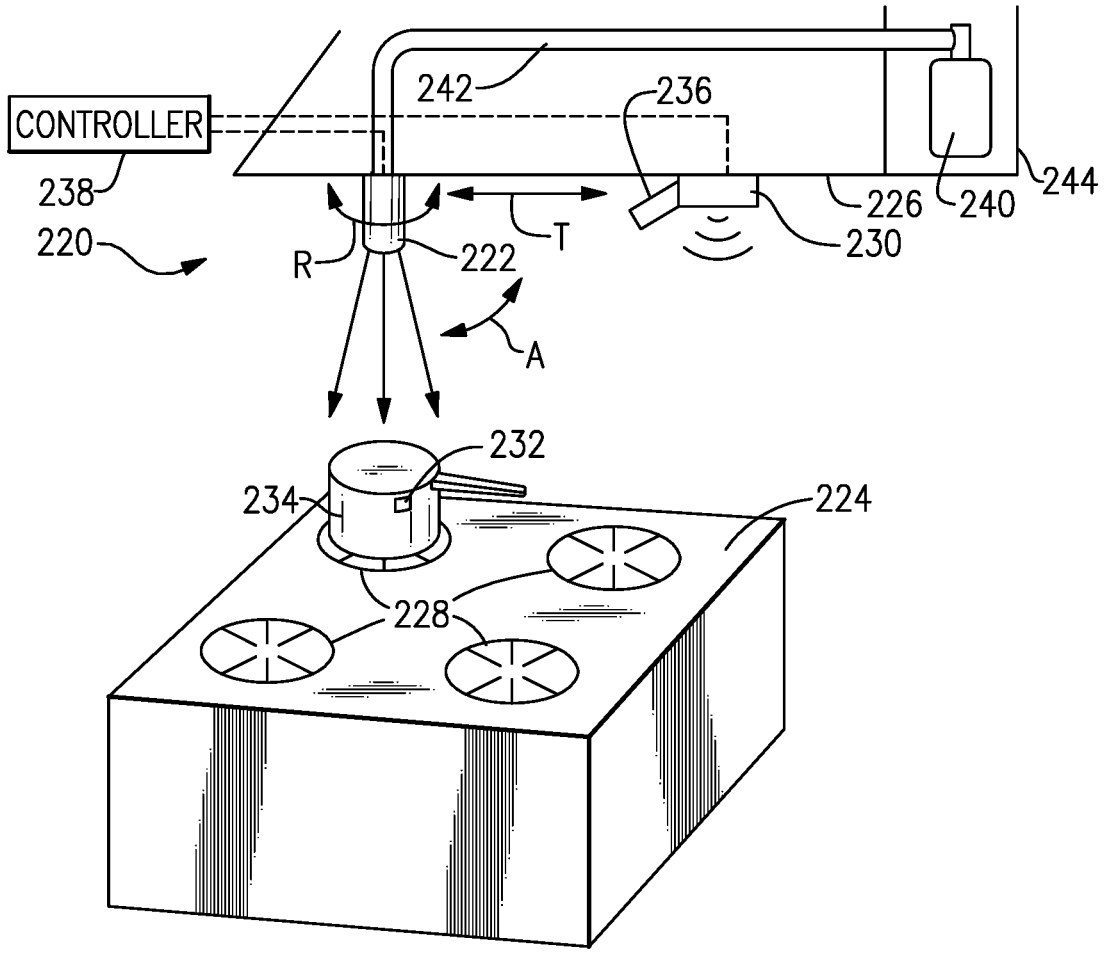
FIG. 3 illustrates a fire suppression system.

FIG. 3 illustrates a fire suppression system 220. A tracking system 230 monitors the appliance, in this example a range top 224, shown schematically. The tracking system 230 may utilize one or more tracking methods, discussed in further detail below, to detect the location of cookware and/or fire on the range top 224. In response to the tracking system 230, the system 220 moves a nozzle 222 to a position to aim at the cookware 234 and/or a fire on the range top 224. As discussed further below, this position may include one or more of a desired coordinate location, rotational position, or angular position. In some examples, the nozzle 222 utilized may be solid stream, full cone, hollow cone, or flat spray.

In some examples, the nozzle 222 may utilize rotational movement R to pivot to a desired position for aiming. Alternatively or additionally, the nozzle 222 may utilize translational movement T to move laterally to aim at a desired position. Alternatively or additionally, the nozzle 222 may utilize angular movement A to angle the nozzle to a desired position. In some examples, the system 220 includes a controller 238 that receives information from the tracking system 230 and sends control signals to actuate the nozzle 222 to move to a desired position, as shown schematically. In some examples, the controller 238 may be programmed with the desired position of the nozzle 222 for each combination of burners 228 being utilized. The tracking system 230 may include one or more sensors 236, such as optical or thermal sensors in some examples.

The controller 238, in some examples, may include one or more computing devices, each having one or more of a computer processor, memory, storage means, network device and input and/or output devices and/or interfaces. The controller 238 is communicatively connected to the tracking system 230 and the nozzle 222, such as through an actuation system (not shown) of the nozzle 222 in some examples. In some examples, the controller 238 is communicatively connected using wired or wireless communications. In some examples, the controller 238 is an analog or electromechanical device configured to provide the disclosed functions of this disclosure. In some examples, the controller may be communicatively connected to the tracking system 230 and/or nozzle 222 through an analog of electromechanical device.

Although a range top 224 is disclosed as an example, other kitchen fire hazard areas, such as fryers, table top burners, open top toasters, griddles, char broilers, and other appliances may benefit from the examples of this disclosure. Although four burners 228 are shown, range tops 224 with more or fewer burners may also benefit from the examples of this disclosure.

In some examples, the tracking system 230 uses object detection to detect the location of a chip 232 embedded in cookware 234 on a burner 228 on a range top 224. The chip 232 may be able to detect and/or indicate temperature information that the system 220 may use to determine whether there is a fire. In some examples, the chip 232 sends signals only when temperatures above a certain threshold are detected. In some examples, the chip 232 sends signals indicative of temperature information continuously, and the controller 238 compares the temperature information to a threshold value to determine whether there is a fire. The tracking system 230 and chip 232 may incorporate active or passive radio frequency identification (RFID), RF-Based Indoor Location Determination, GPS, or other suitable positioning system to identify the location of the chip 232. In one example, the chip 232 may communicate temperature information to the tracking system 230 using a signal, such as radio or Bluetooth, to the tracking system 230 and/or communicate with the tracking system 230 through the internet (IoT), and the tracking system 230 may locate the chip 232 based on Received Signal Strength Indication (RSSI) or other passive tracking system. In one example, the chip 232 may send its location with respect to the nozzle 222, tracking system 230, or geographic coordinate system using a signal, such as radio or Bluetooth, or other active tracking signal to the tracking system 230 and/or communicate through the internet (IoT) using a suitable form of wireless communication. The nozzle 222 may then move to a desired position where it can most easily reach the cookware 234 in case of a fire.

Alternatively or additionally, the tracking system 230 may utilize thermal tracking to detect the location of a fire on the range top or other appliance 224. Thermal tracking may be done with the use of thermal imaging, thermocouples, or infrared sensors, for example. In some examples, the thermal tracking detects which area of an appliance 224 or which appliance 224 has a fire. The nozzle 222 may then be aimed at the fire in response to the fire detection.

The nozzle 222 is in fluid communication with an agent cylinder 240 through conduit 242. In some examples, all or a portion of the conduit 242 is a flexible hose to accommodate the movement of the nozzle 222. The example cylinder 240 may be located in a cabinet 244 to the side of the hood 226, but other locations may also be utilized.

An advantage of the system 220 is that the nozzle 222 may have a more concentrated targeted spray area than prior art systems, thus utilizing less agent for suppressing fires. The nozzle 222 dispensing area may be more concentrated because the nozzle is able to better target a desired location. In some examples, since less agent is utilized, less cylinders 240 may therefore be required, resulting in cost and space savings. Less nozzles may also be required than in some prior art systems. In some examples, one nozzle 222 may cover an entire kitchen or hood since the system 220 will no longer need to discharge onto all of the appliances, only the area on fire. However, although one nozzle 222 and one cylinder 240 are shown in the illustrative example in FIG. 3, more nozzles and/or cylinders may be utilized in some examples. Since less area is sprayed, this can decrease the amount of clean up necessary after discharge causing, in some cases, decrease in down time.

Example systems 220 may include any combination of translational, rotational, and angular movement.

Figure 4:
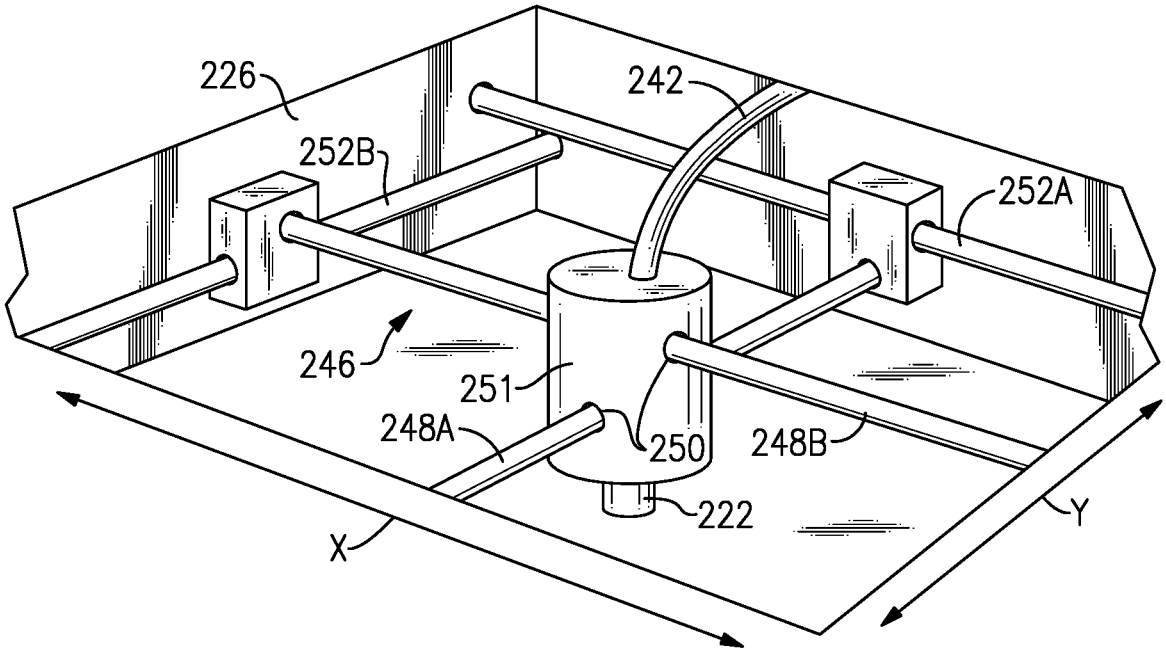
FIG. 4 illustrates an example translational movement system.

FIG. 4 illustrates an example translational movement system 246 for translational movement of the nozzle 222. Tracks 248A and 248B are slidably received within openings 250 of the fixture 251 holding nozzle 222. The nozzle 222 with fixture 251 can move back and forth along the X axis along track 248B and back and forth along the Y axis along track 248A. The track 248A may be slidable along perimeter track 252A fixed to the hood 226, and the track 248B may be slidable along perimeter track 252B fixed to the hood 226. In some examples, the nozzle 222 is movable to a desired X, Y coordinate position for aiming based on detections made by the tracking system 230 and/or instructions from the controller 238 (shown in FIG. 3). A flexible hose 242 is utilized to accommodate movement of the nozzle 222. Although an example translational movement system 246 is shown, other systems for movement in the X, Y and/or Z directions may be utilized.

Figure 5:
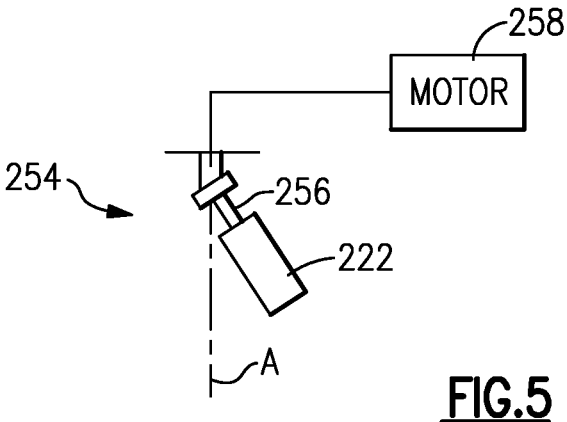
FIG. 5 illustrates an example rotational movement system.

FIG. 5 illustrates an example rotational and angular movement system 254. A swivel joint 256 is pivotally attached to the nozzle 222. The swivel joint 256 may be actuated by a motor 258, such as a servomotor in some examples, to rotate about the axis A to a desired circumferential position for aiming at a desired location. In some examples, angular movement may alternatively or additionally be utilized to vary the angle between the nozzle 222 and the axis A. Although an example rotational and angular movement system 254 is shown, other systems for rotational movement about an axis A may be utilized.

Figure 6:
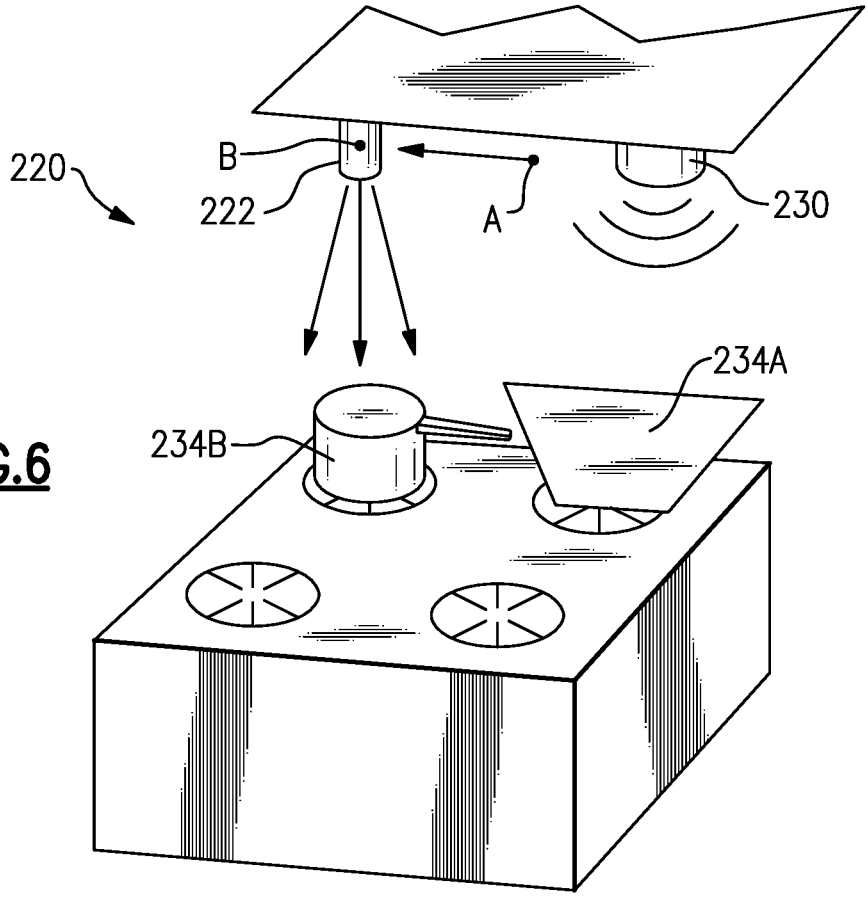
FIG. 6 illustrates an example use of a tracking system of the fire suppression system shown in FIG. 3.

As schematically illustrated in FIG. 6, in some examples, the tracking system 230 may detect the presence of intervening cookware 234A between the nozzle 222 and cookware 234B or another target area. In response, the system 220 may move the nozzle from position A to position B such that the cookware 234A is not between the nozzle 222 and cookware 234B. Although cookware 234A is used in the example shown as an intervening object, the tracking system may be programmed to detect other intervening objects as well, such as other taller cookware, shelves, structures within the hood, and taller appliances that are next to a smaller one.

Figure 7:
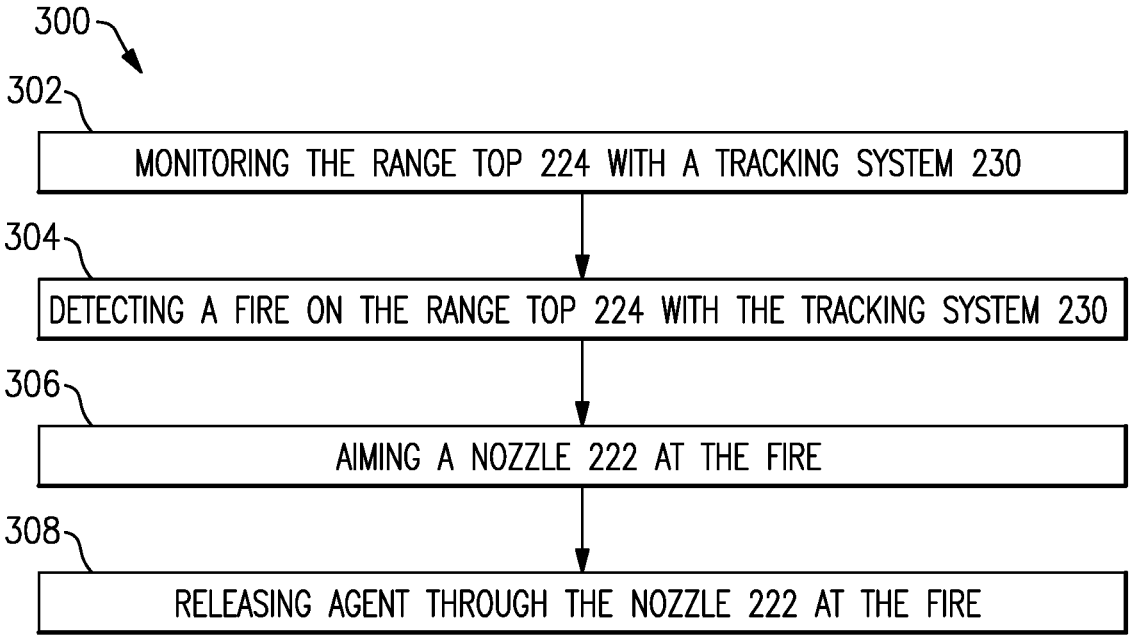
FIG. 7 is a flowchart of an example method of suppressing a fire on a kitchen appliance.

FIG. 7 illustrates a flowchart of a method 300 of suppressing a fire on a range top 224 or other kitchen appliance as illustrated in FIGS. 3 and 6. At 302, the method 300 includes monitoring the range top 224 with a tracking system 230. At 304, the method 300 includes detecting a fire on the range top 224 with the tracking system 230. At 306, the method 300 includes aiming a nozzle 222 at the fire. At 308, the method 300 includes releasing agent through the nozzle 222 at the fire.

The aiming step 306 may include any one or combination of moving the nozzle 222 laterally, rotationally, or angularly, using, for example, one or both of the exemplary movement systems shown and described in FIGS. 4 and 5. In some examples, the method 300 may further include detecting an object between a target area and the nozzle 222, and moving the nozzle 222 such that the object is not between the target area and the nozzle 222. The step of detecting an object between a target area and the nozzle 222 may use tracking system 230.

The systems and methods disclosed can concentrate the required amount of fire suppression agent available towards the fire, efficiently utilizing the agent. There can be less property damage and very little clean up after suppression that may result in less downtime. The systems and methods disclosed will be able to effectively avoid obstacles via tracking.

Although the different embodiments are illustrated as having specific components, the embodiments of this disclosure are not limited to those particular combinations. It is possible to use some of the components or features from any of the embodiments in combination with features or components from any of the other embodiments.

The foregoing description shall be interpreted as illustrative and not in any limiting sense. A worker of ordinary skill in the art would understand that certain modifications could come within the scope of this disclosure. For these reasons, the following claims should be studied to determine the true scope and content of this disclosure.

What is claimed is:

1. A method of suppressing a kitchen fire, the method comprising: detecting a fire and identifying a location of the fire with a tracking system; aiming a nozzle at the location by moving the nozzle laterally along a track within a hood of an appliance; wherein the track includes an X-axis track portion for movement of the nozzle in an X-axis direction and a Y-axis track portion for movement of the nozzle in a Y-axis direction, such that the nozzle is moveable to a desired X, Y coordinate position within the hood based on the detecting; and releasing agent through the nozzle at the location, wherein the agent is stored in a cabinet at a side of the hood.

2. The method as recited in claim 1, wherein the agent is stored in a cylinder not movable along the track, and the nozzle is in fluid communication with the cylinder through a hose to allow movement of the nozzle relative to the cylinder.

3. The method as recited in claim 1, wherein the aiming further includes rotatabaly moving the nozzle about an axis to a desired circumferential position.

4. The method as recited in claim 3, wherein the aiming further includes angularly moving the nozzle to a desired angle between the nozzle and the axis.

5. The method as recited in claim 1, wherein the aiming includes:

detecting an object between a target area and the nozzle; and moving the nozzle such that the object is not between the target area and the nozzle.

6. The method as recited in claim 1, wherein the tracking system includes at least one optical sensor.

7. The method as recited in claim 1, comprising:

receiving temperature information from a chip in a piece of cookware, wherein the detecting includes determining the fire exists based on the temperature information.

8. The method as recited in claim 7, comprising:

identifying a location of the chip with a positioning system.

9. The method as recited in claim 8, where the positioning system is a radio frequency identification system.

10. The method as recited in claim 1, wherein the nozzle includes a fixture with openings for slideably receiving the X-axis track portion and the Y-axis track portion.

11. A fire suppression system for a kitchen, comprising: a tracking system configured to sense a location of a fire in the kitchen; an agent cylinder stored in a cabinet at a side of a hood of an appliance; a nozzle movable laterally along a track within the hood to a select position based on the sensing and configured to release fire suppression agent onto the fire; and wherein the track includes an X-axis track portion for movement of the nozzle in an X-axis direction and a Y-axis track portion for movement of the nozzle in a Y-axis direction, such that the nozzle is moveable to a desired X, Y coordinate position within the hood based on the detecting.

12. The system as recited in claim 11, comprising a swivel joint pivotally attached to the nozzle, wherein the nozzle is further movable rotatably about an axis to a desired circumferential position to the select position, wherein the rotatable movement includes rotation of the swivel joint.

13. The system as recited in claim 11, further comprising a controller configured to send control signals to move the nozzle based on the sensing.

14. The system as recited in claim 11, wherein the tracking system includes an infrared sensor for sensing the location of the fire.

15. The system as recited in claim 11, wherein the nozzle is in fluid communication with the agent cylinder through a flexible hose, and the agent cylinder is not movable along the track, such that the flexible hose allows movement of the nozzle relative to the cylinder.

16. A fire suppression system for a kitchen, comprising: a tracking system configured to sense a location of a fire in the kitchen; an agent cylinder stored in a fixed position in a cabinet at a side of a hood of an appliance; a nozzle in fluid communication with the agent cylinder through a flexible hose to allow for movement of the nozzle relative to the cylinder, the nozzle movable laterally along a track within the hood to a select position based on the sensing and configured to release fire suppression agent onto the fire; wherein the track includes an X-axis track portion for movement of the nozzle in an X-axis direction, a Y-axis track portion for movement of the nozzle in a Y-axis direction; and a swivel joint pivotally attached to the nozzle, wherein the nozzle is further movable rotatably about an axis to a desired circumferential position to the select position by rotating the swivel joint, and the nozzle is movable angularly to vary an angle between the nozzle and the axis to the select position.

17. The fire suppression system as recited in claim 16, wherein the tracking system is configured to detect an object between a target area and the nozzle and move the nozzle to the select position such that the object is not between the target area and the nozzle.

18. The fire suppression system as recited in claim 16, comprising a fixture holding the nozzle and including a plurality of openings, wherein the track is slidably received within then plurality of openings, and the flexible hose extends from the cylinder to the fixture.

19. The fire suppression system as recited in claim 16, wherein the track includes a first perimeter track portion, a second perimeter track portion, wherein the X-axis track portion is slideable along the first perimeter track portion, and the Y-axis track portion is slideable along the second perimeter track portion, such that the nozzle is moveable to a desired X, Y coordinate position within the hood based on the sensed location, wherein the nozzle includes a fixture with openings for slideably receiving the X-axis track portion and the Y-axis track portion.

* * * * *